US007228597B2

(12) United States Patent
Gerali et al.

(10) Patent No.: US 7,228,597 B2
(45) Date of Patent: Jun. 12, 2007

(54) PARTITION APPARATUS AND HINGE APPARATUS

(75) Inventors: David A. Gerali, Mount Prospect, IL (US); Tim Schnittker, Elmhurst, IL (US); Henri Lodewyck, Clarendon Hills, IL (US); Charles Gambo, Downers Grove, IL (US)

(73) Assignee: Gerali Custom Design, Inc., Elgin, IL (US)

( * ) Notice: Subject to any disclaimer, the term of this patent is extended or adjusted under 35 U.S.C. 154(b) by 483 days.

(21) Appl. No.: 10/263,368

(22) Filed: Oct. 2, 2002

(65) Prior Publication Data

US 2003/0196297 A1 Oct. 23, 2003

Related U.S. Application Data

(60) Provisional application No. 60/374,701, filed on Apr. 23, 2002.

(51) Int. Cl.
*E05D 5/10* (2006.01)
*E05D 5/02* (2006.01)

(52) U.S. Cl. ..... 16/382; 16/254; 16/387; 16/312; 16/315; 160/229.1; 160/228; 49/399

(58) Field of Classification Search ..... 16/382, 16/254 X, 388, 387 X, 312 X, 314, 315 X, 16/271 X, 272, 357, 360, 387, 234, 254, 16/261, 266, 267, 271; 49/399 X, 397; 160/229.1 X, 160/228 X; 296/106
See application file for complete search history.

(56) References Cited

U.S. PATENT DOCUMENTS 12,692 A * 4/1855 Parham ..... 138/44
1,035,661 A * 8/1912 Toms et al. ..... 29/11
1,072,364 A * 9/1913 Roberts ..... 16/317
1,743,273 A * 1/1930 Hammer ..... 312/242
2,373,955 A * 4/1945 Fuller ..... 16/238
2,684,714 A * 7/1954 Corey ..... 160/199

(Continued)

FOREIGN PATENT DOCUMENTS

DE 3615748 A1 * 11/1987

(Continued)

OTHER PUBLICATIONS

Jacknob® Corp. Toilet Partition Hardware sales brochure, including a cover page and p. 11 (2 pages).

(Continued)

*Primary Examiner*—Brian E. Glessner
*Assistant Examiner*—Mark Williams
(74) *Attorney, Agent, or Firm*—Pauley Petersen & Erickson

(57) ABSTRACT

A partition apparatus or system having one or more panels each releasably fixed with respect to a hinge element. The hinge element has at least one hinge leaf, each with an outer edge. Each hinge leaf has at least one opening, preferably multiple openings, extending from the outer edge in a direction inward toward the hinge pin. The panel at least partially defines a slot. A male connector is mounted within the slot. The hinge leaf can be inserted within the slot so that the male connector engages within the opening of the hinge leaf. The opening of the hinge leaf can be shaped so that the hinge element is releasably fixed with respect to the panel.

18 Claims, 9 Drawing Sheets

U.S. PATENT DOCUMENTS 2,885,722 A * 5/1959 Halliday ..... 16/237
3,590,419 A * 7/1971 Dargene ..... 16/235
3,608,613 A * 9/1971 Halliwell ..... 160/229.1
3,906,670 A * 9/1975 Burton ..... 49/381
3,965,532 A * 6/1976 Wigfall ..... 16/270
4,190,221 A * 2/1980 Updike ..... 248/551
4,368,558 A * 1/1983 Grass ..... 16/332
4,407,044 A * 10/1983 Iseki ..... 16/237
4,506,409 A * 3/1985 Lautenschlager ..... 15/238
4,749,018 A * 6/1988 Alten ..... 160/229.1
4,991,639 A * 2/1991 Clay et al. ..... 160/201
5,067,200 A * 11/1991 Stowell et al. ..... 16/237
5,193,308 A * 3/1993 Davidian ..... 49/381
5,367,745 A * 11/1994 Roloff ..... 16/312
5,411,072 A * 5/1995 Starck et al. ..... 160/84.11
5,624,170 A * 4/1997 Hasty ..... 312/329
6,286,918 B1 * 9/2001 King ..... 312/326
2004/0034966 A1 * 2/2004 Wegman ..... 16/254

FOREIGN PATENT DOCUMENTS

DE 3932733 A1 * 4/1991
GB 2200683 A * 8/1988

OTHER PUBLICATIONS

Digital photographs of a hinge (2 pages).

* cited by examiner

PARTITION APPARATUS AND HINGE APPARATUS

CLAIM FOR BENEFIT OF PRIOR U.S. PROVISIONAL APPLICATION

I claim the benefit under 35 U.S.C. §119(e) of U.S. Provisional Patent Application having Ser. No. 60/374,701, filed on Apr. 23, 2002.

BACKGROUND OF THE INVENTION

1. Field of the Invention

This invention relates to a partition apparatus having a hinge element with a hinge leaf that can be concealed by a panel of the partition apparatus. This invention also relates to a hinge apparatus having a hinge leaf that can be inserted into a slot within a panel and moved with respect to the panel, to fix a position of the hinge with respect to the panel. This invention also relates to a hinge apparatus that can be used to set a position of a panel, such as a door panel, when the partition apparatus is in an open condition.

2. Description of Related Art

Conventional partition apparatuses or systems often include panels connected with respect to each other to form an enclosure. The enclosures can be used to enclose a toilet facility, a shower facility or another area or space.

Conventional partition systems use external hardware, such as brackets, hinges and other external components, to connect the panels with respect to each other.

Also with conventional partition systems, the doors can remain closed when the enclosed space is unoccupied.

There is an apparent need to provide a partition apparatus that can be easily assembled in the field, particularly without tools. There is also a need to provide a partition apparatus that conceals attachment hardware, for an aesthetically pleasing appearance.

SUMMARY OF THE INVENTION

It is one object of this invention to provide a partition apparatus that has a hinge element that is at least partially concealed by a panel.

It is another object of this invention to provide a partition system which can be easily assembled in the field, without tools.

It is another object of this invention to provide a hinge element that maintains a door panel in an open position, for example when a space enclosed by the partition is unoccupied.

The above and other objects of this invention are accomplished with a partition apparatus or system having at least one panel connected to a hinge element. The hinge element has at least one hinge leaf, preferably two hinge leaves, each mounted to pivot about a hinge axis of the hinge element. The hinge leaf has a peripheral edge or side with at least one opening extending inward from the peripheral edge, toward the hinge axis. A pin can be mounted within a slot that is at least partially defined by the panel.

For quick assembly in the field, even without tools, the hinge leaf is slid into the slot so that the pin fits within the opening at the peripheral edge of the hinge leaf. Preferably but not necessarily, the opening has a T shape or another suitable shape that accepts the pin. With a T shaped opening, the hinge leaf can be slid into the slot, then the hinge leaf can be moved in a direction generally parallel to the hinge axis, to position the pin within a crossbar portion of the T shape, to fix the position of the hinge leaf with respect to the panel.

In one embodiment of this invention, the hinge element has two hinge leaves, one on each side of the hinge element. A second panel can be attached to the second hinge leaf in a manner which is similar to the first hinge leaf. With such arrangement, for example, a door panel can be hingedly mounted with respect to a fixed panel of the partition system. The second hinge leaf can be connected to or integrated with a second panel, such as a door panel.

The opening preferably but not necessarily has a shape which is symmetrical about a general longitudinal axis running through the opening. For example, with a symmetrical T shape, it is possible to remove from the slot and then invert or rotate the hinge element 180° and still use the same type of connection, again without the need for any tool.

The invertible feature of the hinge element allows a door panel to be quickly removed and converted from a right-hand or left-hand swing open to a right-hand or left-hand swing closed door arrangement. It is apparent that other suitable shapes of the opening can accomplish the same result.

The hinge apparatus of this invention can be used with panels to form a partition apparatus or system. However, the hinge apparatus of this invention can also be used with other panels, elements or other suitable objects to allow one structural body to be hingedly or pivotably attached with respect to another structural body, particularly wherein one or more structural bodies conceal at least a portion of one or more hinge leaves.

In another embodiment of this invention, the hinge element can be designed to set the first panel at an acute angle with respect to the second panel, for example, when the hinge apparatus is in an at rest position. Thus, for example, with a partition used to provide privacy to a toilet facility, the door panel can be gravity fed or forced into an open position. Thus, when the toilet facility is unoccupied, the door can remain open, in an at rest position.

BRIEF DESCRIPTION OF THE DRAWINGS

The features of this invention can be better understood when the specification is read in view of the drawings, wherein.

DESCRIPTION OF PREFERRED EMBODIMENTS

Figure 1:
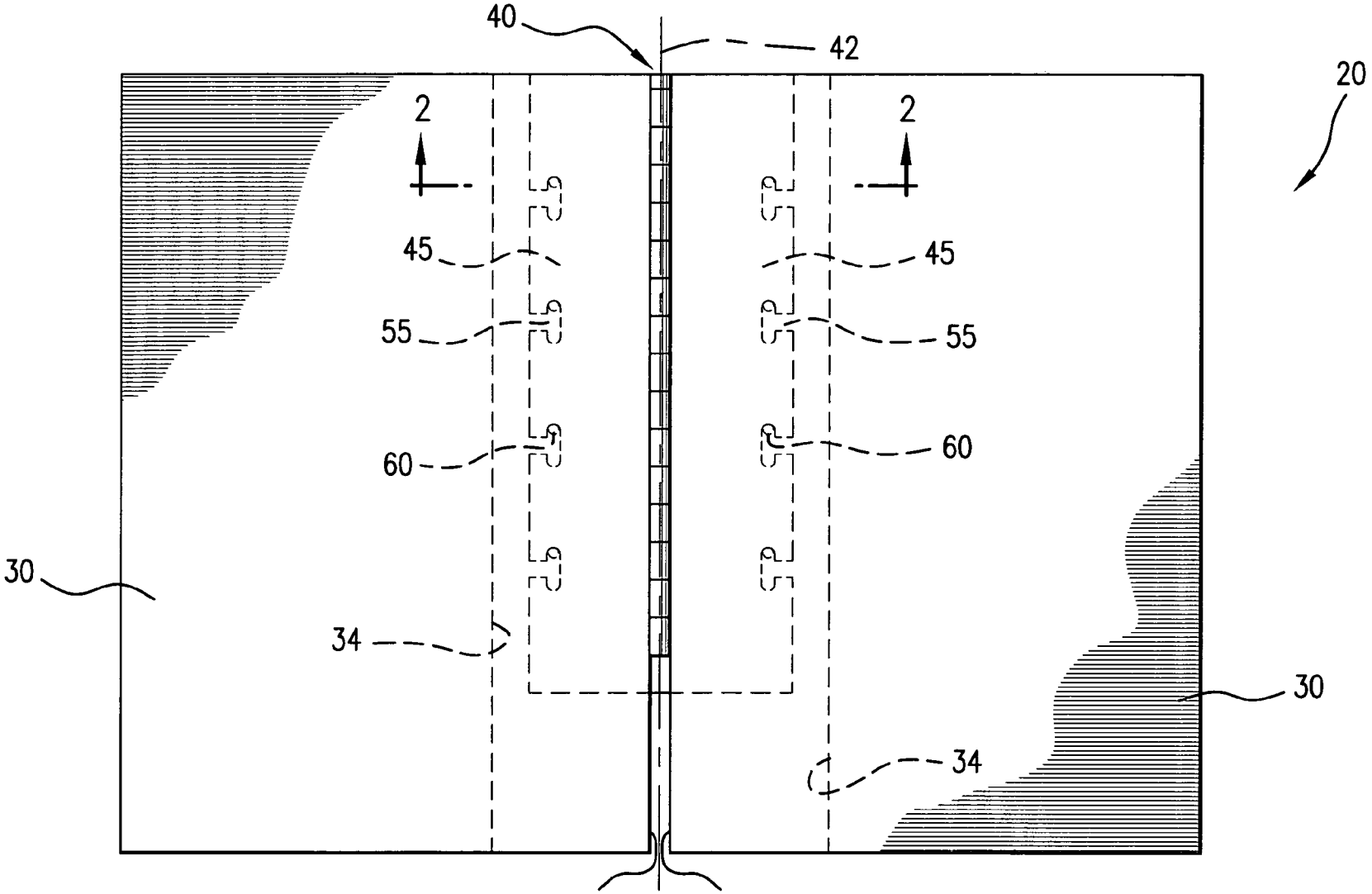
FIG. 1 is a front view of a partition apparatus, including two panels and one hinge apparatus with two hinge leaves, according to one embodiment of this invention.
Figure 2:
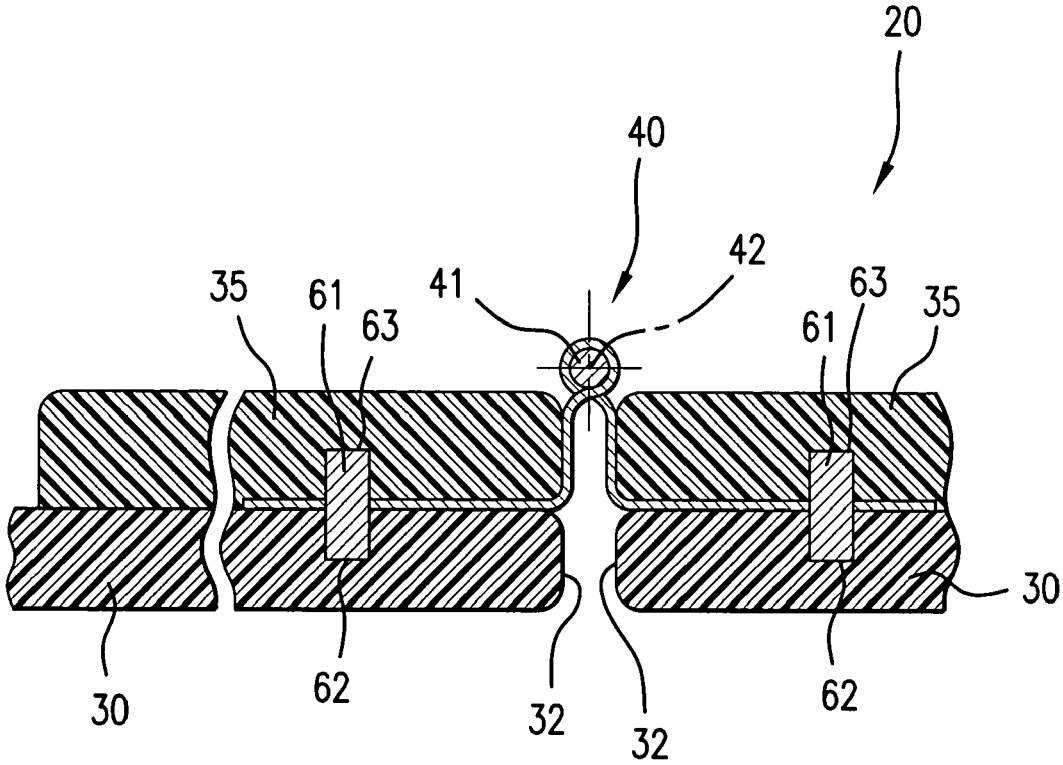
FIG. 2 is a sectional view, taken along line 2—2 shown in FIG. 1, of a portion of the partition apparatus as shown in FIG. 1.
Figure 4:
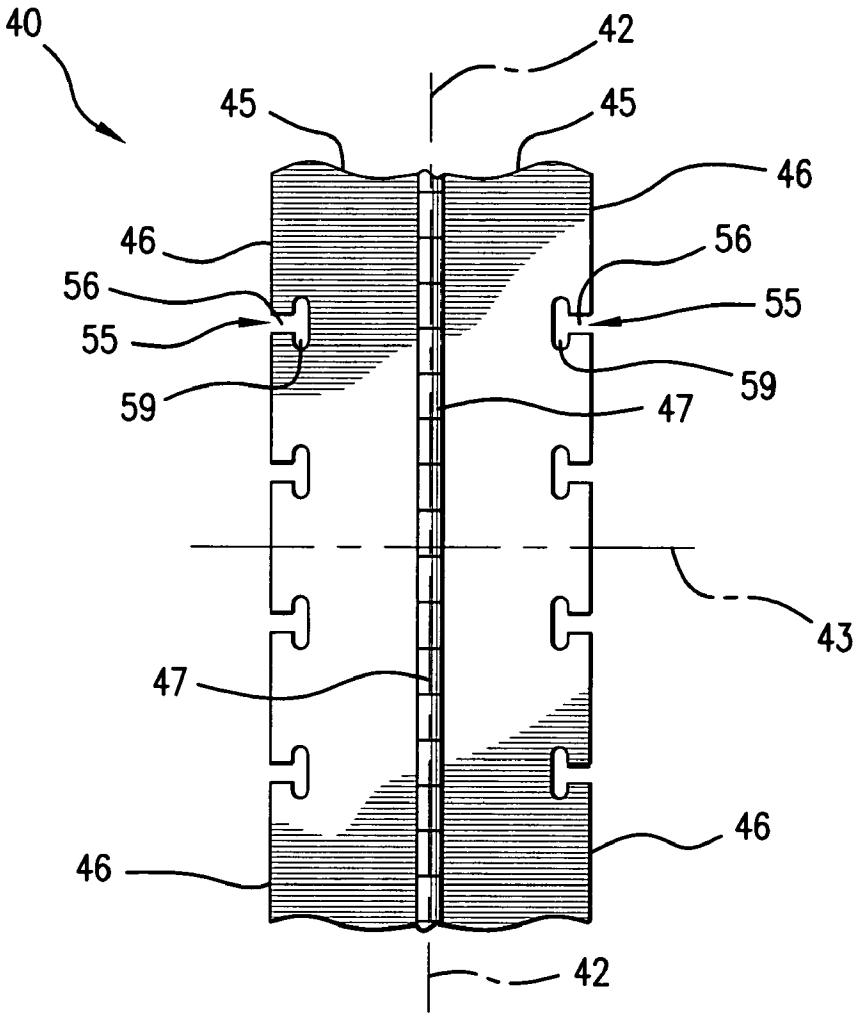
FIG. 4 is a front view of a hinge apparatus, according to one embodiment of this invention.

FIGS. 1 and 2 show different views of an assembled partition apparatus 20, according to one embodiment of this invention. FIG. 4 shows a front view of hinge element 40, according to one embodiment of this invention. This invention provides a simple partition apparatus 20 to manufacture and to field install. Because hinge element 40 can be fixed with respect to panel 30 without screws or other field-installed fasteners, hinge element 40 can be quickly fixed with respect to one or more panels 30.

In one embodiment of this invention, hinge element 40 can be inverted 180° and field-installed in the same manner, without the need for tools, screws or other field-installed fasteners.

Also, because hinge element 40 can be easily inverted, when used as a door panel, for example, panel 30 can be reversed between a left-hand position and a right-hand position, and thus can be reversed between a swing-in arrangement and a swing-out arrangement.

As shown in FIGS. 1–4, a first panel 30 can be releasably fixed with respect to a second panel 30 by using one hinge element 40 to attach both panels 30. Although FIG. 1 shows two panels 30 attached with respect to each other, this invention is also intended to encompass hinge element 40 connected to one panel 30 and connected in another suitable mechanical fashion to another structural member, such as a wall, a bracket, a pilaster or the like. Different elements and features discussed throughout this invention can be applied to hinge element 40 that is attached to one or more panels 30. As different embodiments are discussed throughout this specification and in the claims, the use of plural language is intended to correspond to singular language and the use of singular language is intended to apply to plural language.

Figure 3:
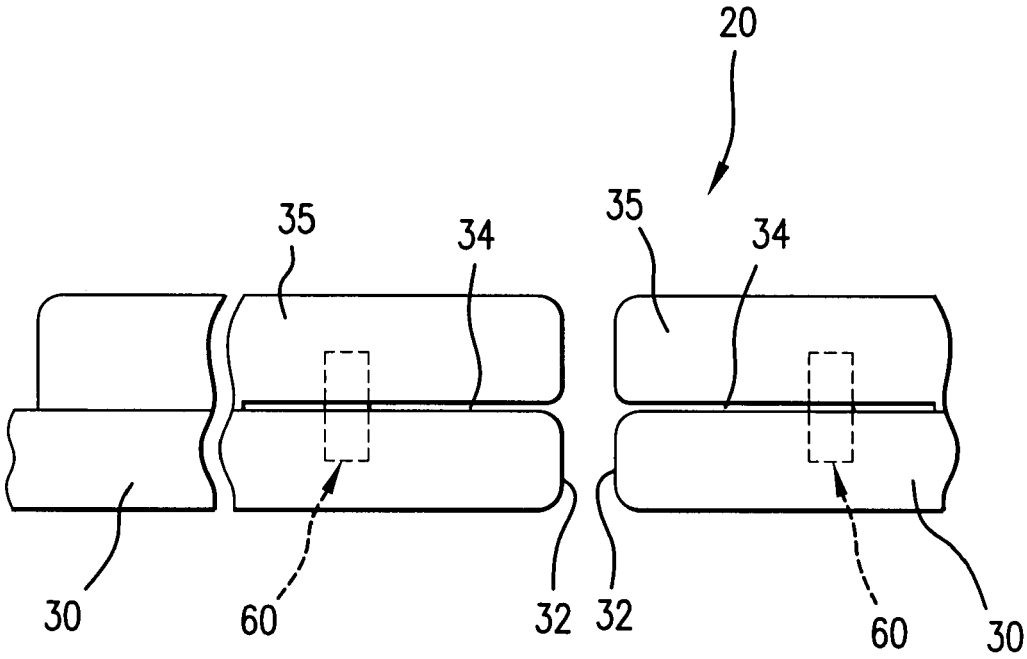
FIG. 3 is a top view of the partition apparatus as shown in FIG. 1.

FIGS. 1–3 show panel 30 having edge portion 32. Panel 30 at least partially defines slot 34. As shown in FIG. 3, each slot 34 is defined between panel 30 and supplemental panel 35. In different embodiments of this invention, supplemental panel 35 may or may not extend a full length of slot 34 and/or panel 30, and may or may not extend a full width of panel 30. Supplemental panel 35 not extending the full width is shown in FIGS. 2 and 3.

Panel 30 can be the only member defining slot 34. However, to simplify the manufacturing process associated with installing male connectors 60, as further discussed below, slot 34 is formed between panel 30 and supplemental panel 35. Supplemental panel 35 can be adhered, fastened or otherwise connected or attached with respect to panel 30.

As shown in FIG. 4, hinge element 40 has hinge leaf 45 mounted to pivot about hinge axis 42. In one embodiment of this invention, hinge pin 41 defines hinge axis 42. Hinge pin 41 preferably but not necessarily has a circular cross section.

FIG. 4 shows hinge leaf 45 having peripheral edge 46 with at least one opening 55 extending inward from peripheral edge 46, toward hinge axis 42. FIG. 2 shows male connector 60 mounted within slot 34. Hinge leaf 45, which can be constructed of plate material or another suitable relatively flat material, can be slid into slot 34. Hinge leaf 45 is preferably moved or positioned so that male connector 60 enters opening 55. Hinge leaf 45 is then pushed or inserted further into slot 34. Hinge leaf 45 can be moved in a direction generally parallel to hinge axis 42 to seat or lock male connector 60 within slot 34.

When male connector 60 is fully positioned within or locked within slot 34, gravity forces and/or frictional forces between hinge element 45 and panel 30 and/or supplemental panel 35 fix or secure the relative position of hinge leaf 45 with respect to panel 30. As shown in FIG. 2, at least a portion of hinge leaf 45 as well as male connector 60 can be concealed within slot 34 and hidden by panel 30 and/or supplemental panel 35. Thus, hinge leaf 45 is not visible from either side of panel 30, which results in an aesthetically pleasant appearance, particularly compared to conventional attachments that use external brackets and screw or other externally mounted mechanical fasteners.

Because male connector 60 is removeably engageable within opening 55, hinge leaf 45 is releasably fixed in a mounted position with respect to panel 30. Partition apparatus 20 can thus be easily disassembled and reassembled in the field, particularly without the need for tools.

In one embodiment of this invention, male connector 60 comprises pin 61, such as shown in FIG. 2. However, male connector 60 can comprise any other suitable structural element that can engage within opening 55 of hinge leaf 45.

Opening 55 can have many different shapes to accomplish the result of allowing hinge leaf 45 to move inward within slot 34 and then to move in a direction generally parallel to hinge axis 42, to releasably fix hinge element 40 with respect to panel 30. FIGS. 5–10 each show a different embodiment of a shape of opening 55. The shapes shown in FIGS. 5–10, or any other suitable shape, can be used to allow male connector 60 to move in a direction that has two components, one direction component generally perpendicular to hinge axis 42 and another direction component generally parallel to hinge axis 42.

The shape of opening 55 preferably is designed so that a force generally perpendicular to hinge axis 42 and directed away from hinge axis 42, when applied to hinge leaf 45 does not move hinge leaf 45 with respect to panel 30 and thus remove hinge leaf 45 from within slot 34.

Figure 5:
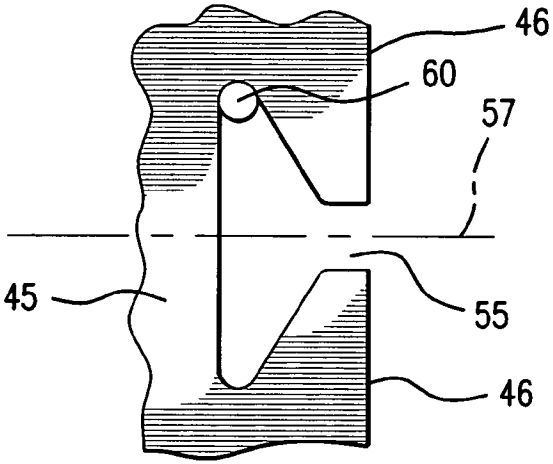
FIGS. 5–10 each is a partial front view of a hinge apparatus, showing different shapes for an opening in a hinge leaf, according to different embodiments of this invention.
Figure 6:
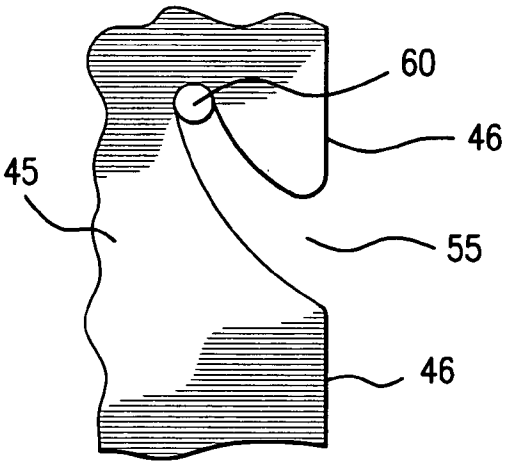
Figure 9:
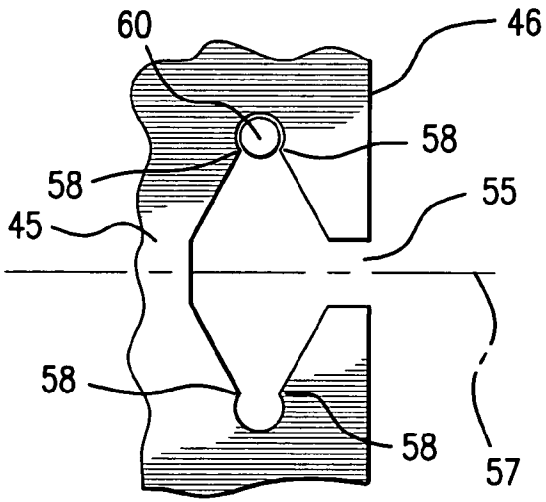
Figure 10:
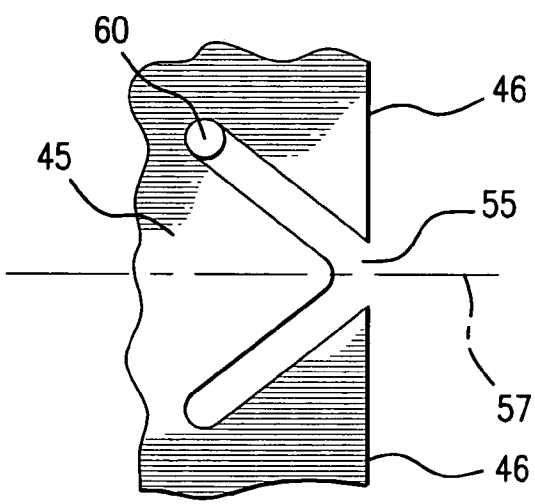
Figure 11:
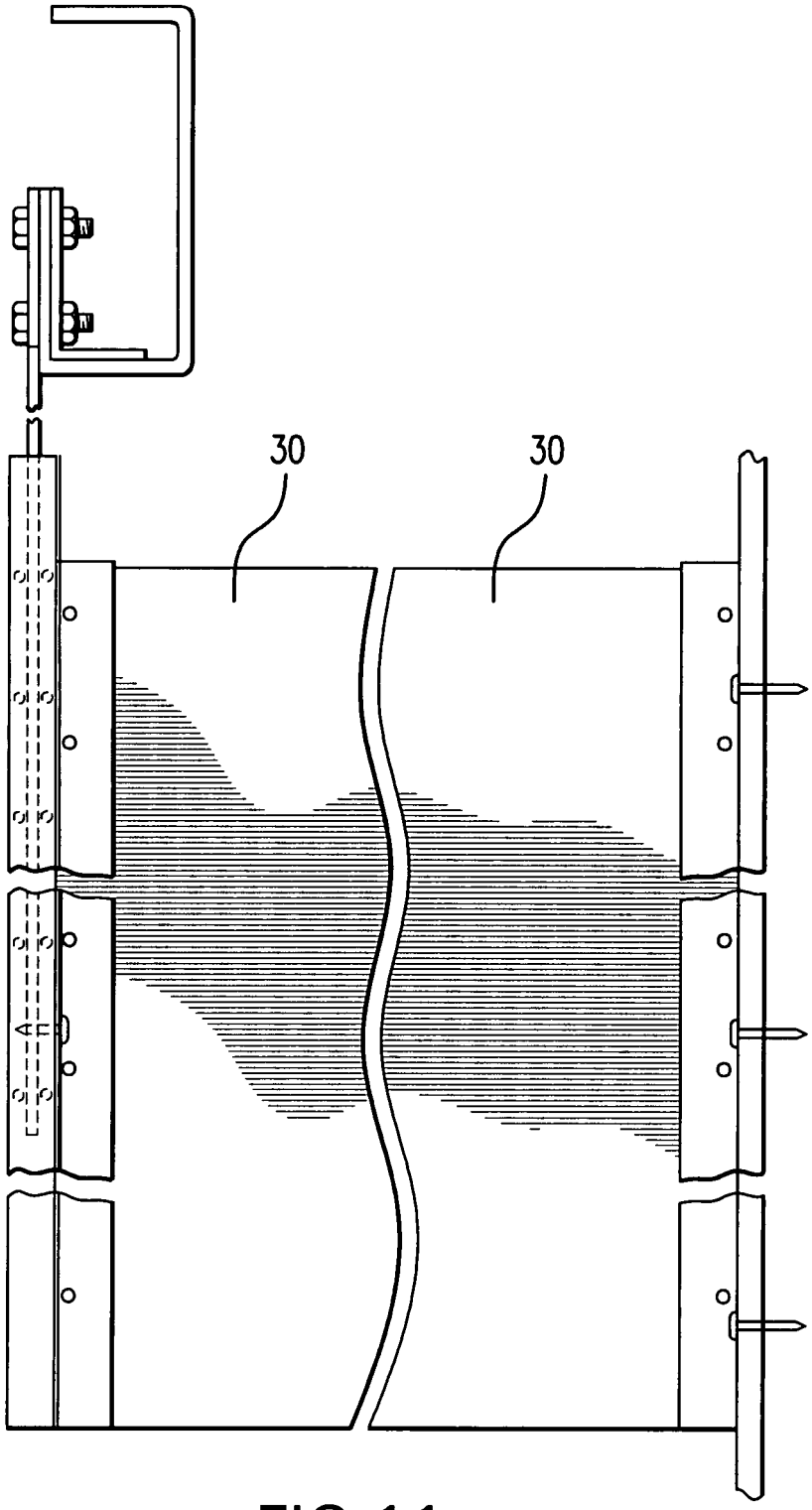
FIG. 11 is a front schematic view of a partition system in an assembled condition, according to one embodiment of this invention.
Figure 12:
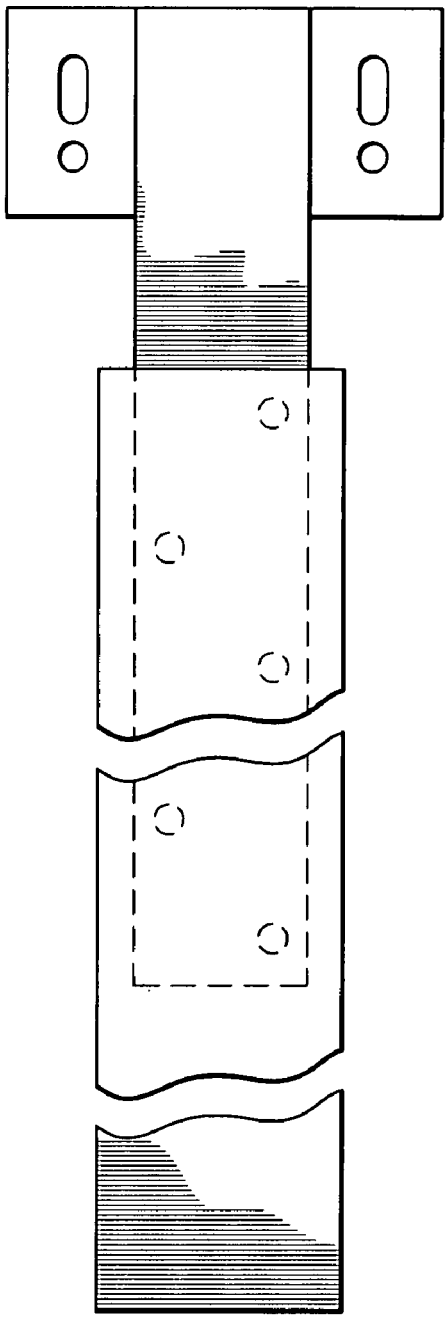
FIG. 12 is a side view of the partition system as shown in FIG. 11.

When opening 55 is generally symmetric about axis 57, such as shown in FIGS. 5, 9 and 10, hinge leaf 45 can be inverted 180° and reinserted within slot 34. Opening 55 does not need to be precisely symmetric about axis 57, to accomplish the same result.

Figure 7:
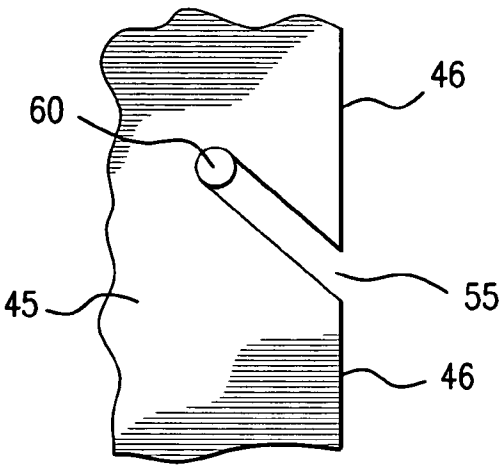
Figure 8:
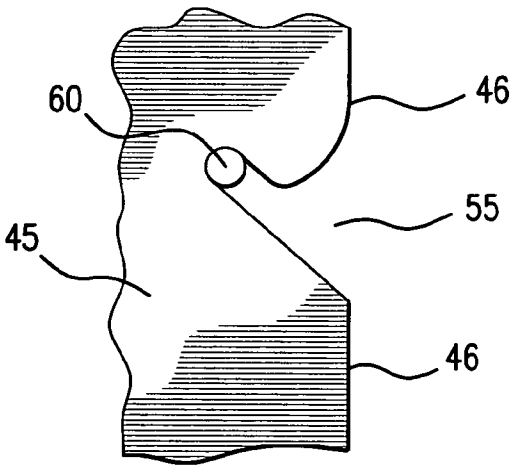

In many embodiments of this invention, the shape of opening 55 diverges in a direction away from peripheral edge 46, such as shown in FIGS. 5, 6 and 8–10. The shape of opening 55 in FIG. 7 shows that even when opening 55 does not diverge in such direction, opening 55 can still be used to accomplish the same result of fixing hinge leaf 45 with respect to panel 30.

FIG. 9 shows one embodiment of opening 55 where projections 58 are used to create a snap action as male connector 60 moves into its fixed position, to more positively lock the position of male connector 60 with respect to hinge leaf 45.

FIG. 4 shows each opening 55 having an overall T shape, with base portion 56 adjacent peripheral edge 32 and base portion 56 merging into crossbar portion 59.

As shown in FIG. 1, partition apparatus 20 has first panel 30 and second panel 30 pivotally connected with respect to each other by hinge element 40. The second panel 30 can have features similar to the first panel 30. In one embodiment of this invention, hinge element 40 comprises at least one hinge leaf 45 pivotally mounted with respect to hinge pin 41. Each hinge leaf 45 can be releasably fixed with respect to panel 30, or with respect to any other structural element that defines a slot and has a male connector within the slot.

In one embodiment of this invention, each hinge leaf 45 of hinge element 40 has a plurality of openings 55 spaced apart from each other along peripheral edge 46. Openings 55 can be equally spaced apart from each other, which accommodates the reversible feature of hinge element 40. However, other non-equal spacings can also be used to accomplish the reversible feature, such as when unequal spacings are symmetric about centerline axis 43, such as shown in FIG. 4.

Although hinge leaf 45 is preferably made of a relatively flat material, it is apparent that differently shaped materials, such as corrugated materials or other non-planer or non-flat materials, can be used as long as hinge leaf 45 can be inserted within slot 34.

Side portion 47 of hinge leaf 45 can be bent or otherwise formed to fit around hinge pin 41. For example, side portion 47 can be formed about more than 180° of an outer circumference of hinge pin 61, so that hinge leaf 45 is pivotably mounted with respect to hinge pin 41. As shown in FIG. 4, hinge element 40 has two hinge leafs 45 positioned about hinge pin 41.

As shown in FIG. 7, general longitudinal axis 57 of opening 55 can be positioned at acute angle A, with respect to hinge axis 42.

Figure 14:
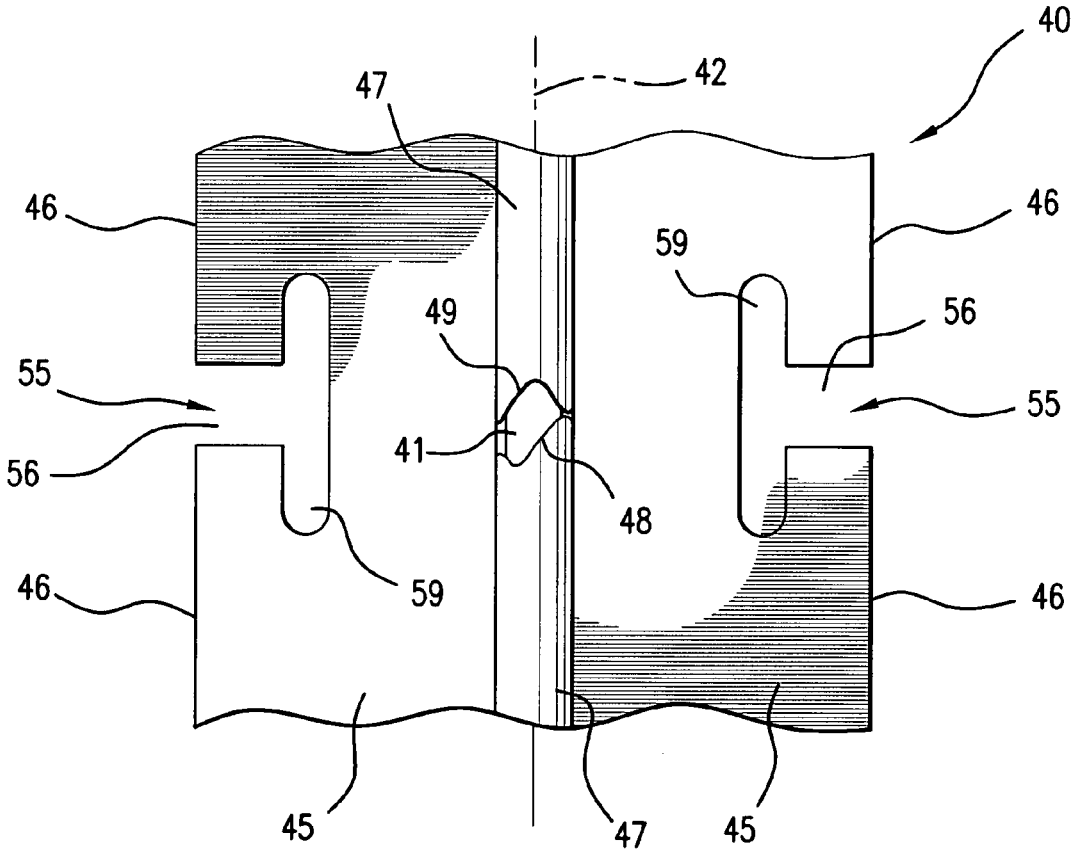
FIG. 14 is a front view of a hinge apparatus, according to another embodiment of this invention.
Figure 15:
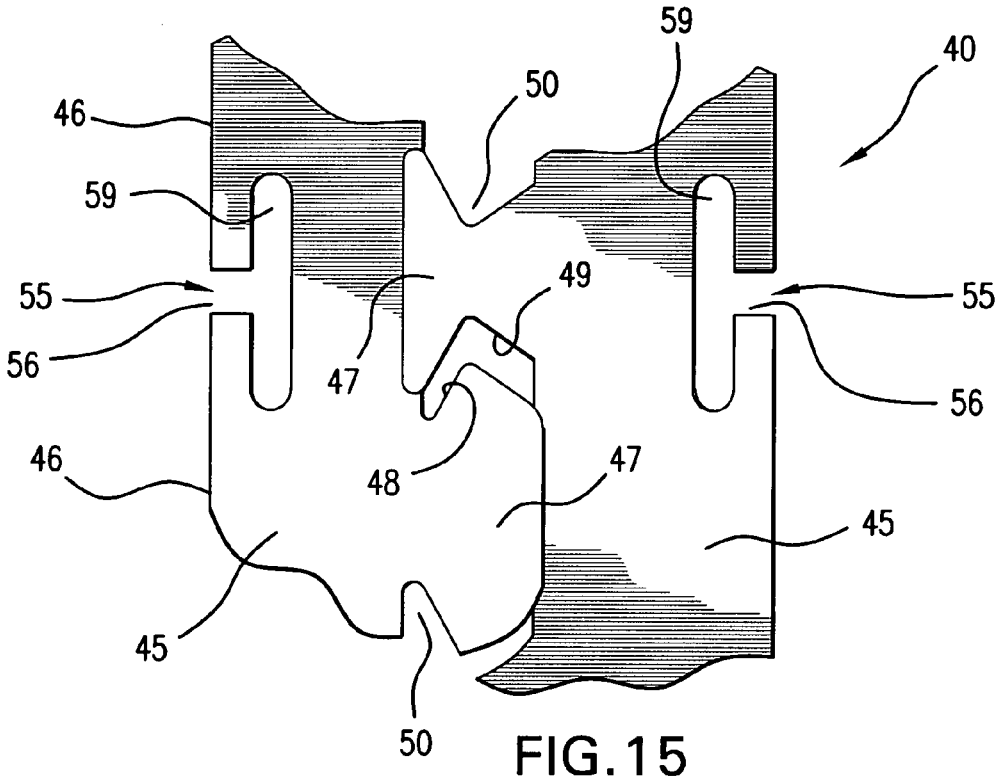
FIG. 15 is a front view of the two hinge leaves shown in FIG. 14, in a plate material condition, before a side portion of the hinge leaves are bent to fit around a hinge pin.

FIGS. 14 and 15 show hinge element 40 according to another embodiment of this invention. Side portion 47 of one hinge leaf 45 forms cam surface 48 and side portion 47 of another corresponding hinge leaf 45 forms follower surface 49. Cam surface 48 and follower surface 49 can be designed to cooperate with each other so that when both hinge leaves 45 are pivoted with respect to each other, follower surface 49 contacts cam surface 48. As shown in FIG. 14, follower surface 49 will bottomout at a particular radial position of hinge leaves 45 with respect to each other. The radial position can be selected so that when panel 30 is used as a door panel, for example on partition apparatus 20 covering a toilet facility, the door remains propped open in an at rest position and must be forced into a closed position. Hinge element 40 can be designed so that gravity forces of the door element acting upon hinge element 40 move hinge leaves 45 into the bottomout position. The particular angle where the bottomout position occurs can be varied. Also, any spring or other bias force can be used to act in the place of or with or against the gravity forces.

The outer diameter of hinge pin 41 and/or the inner diameter formed by side portion 47 can be varied to change the peripheral gap between the outside surface of hinge pin 41 and the inside surface of side portion 47 when bent around hinge pin 41. The dimension of the peripheral gap can be varied to increase or decrease frictional resistance so that it is more difficult or easier, respectively to pivot both hinge leaves 45 with respect to each other. Varying the peripheral or annular gap and thus varying the frictional resistance can be used to make it easier or more difficult to move both hinge leaves 45 with respect to each other.

Figure 16:
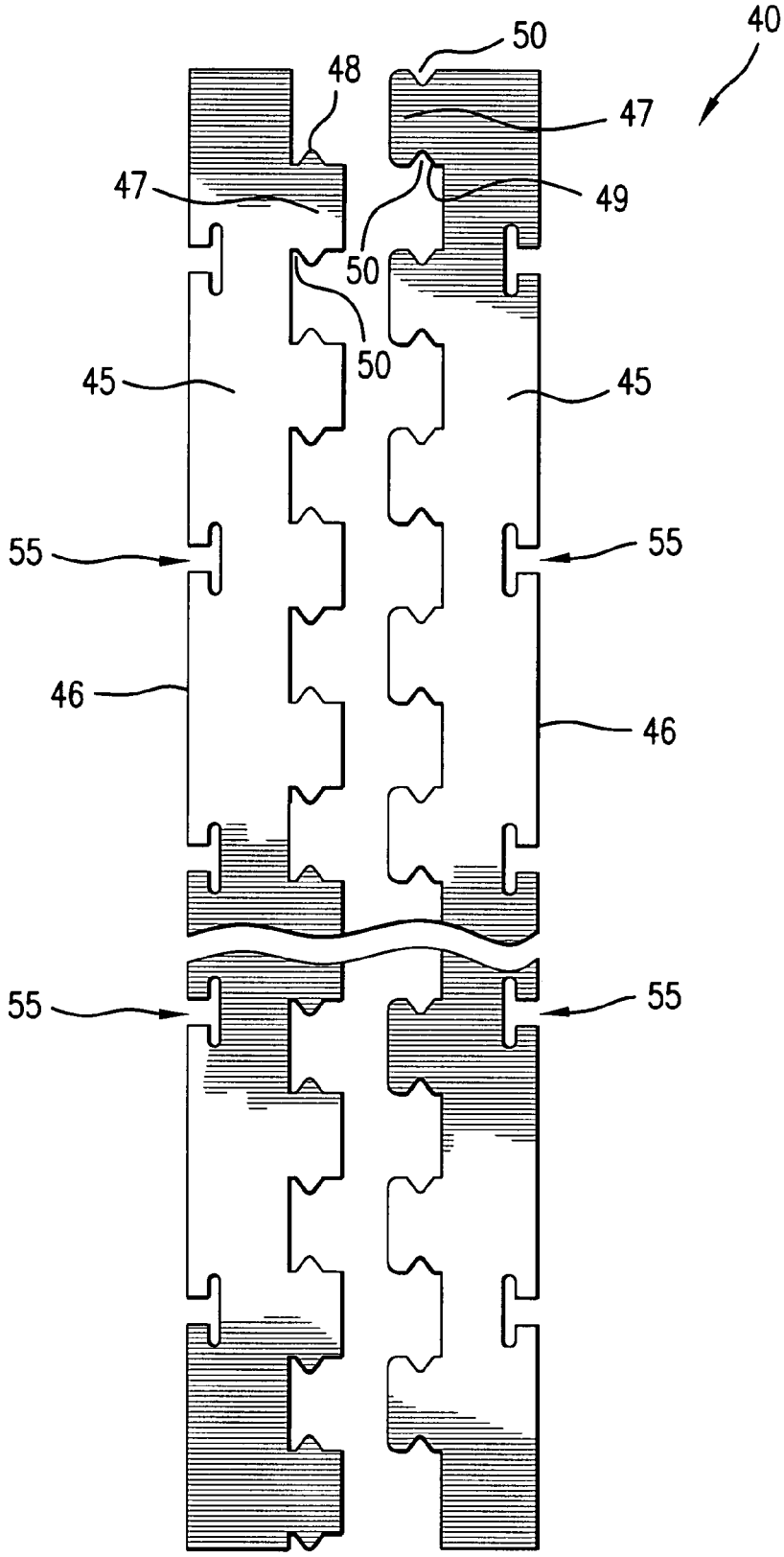
FIG. 16 is a front view of two hinge leaves in a plate material condition or a flat condition, before a side portion of the hinge leaves are bent to fit around a hinge pin, according to another embodiment of this invention.

FIG. 16 shows another embodiment of two hinge leaves 45, in a flat condition, before side portions 47 are bent to fit around hinge pin 41. FIG. 15 shows two hinge leaves 45 partially overlapping each other. FIG. 16 shows two hinge leaves 45 spaced apart from each other.

In one embodiment of this invention, cam surface 48 has an overall V shaped cutout 50. In another embodiment of this invention, cutout 50 can have an overall U shape. FIGS. 15 and 16 show two differently shaped cutouts 50. Other suitable shapes can be used to accomplish the same result of fixing the radial position of both hinge leaves 45 with respect to each other, in the at rest position.

Slot 34 can extend the entire length of edge portion 32 of panel 30, or can extend along any portion of the length of slot 34. Hinge element 40 can be continuous along the length of edge portion 32. In another embodiment, a plurality of hinge elements 40 can be intermittently spaced along the length of slot 34. A continuous hinge element 40 provides more privacy because hinge element 40 fills the gap between the first and the second panels 30.

In embodiments of this invention that use supplemental panel 35, closed bores can be fabricated within the inside portion of both supplemental panel 35 and panel 30. Male connectors 60 can be inserted within the closed bores, with or without adhesives, friction fits or other mechanical or non-mechanical ways of fixing male connector 60 with respect to panel 30 and/or supplemental panel 35. With partition apparatus 20 in the assembled condition, male connector 60 can be fixed or moveable with respect to panel 30 and/or supplemental panel 35.

The connection between hinge element 40 and panel 30 according to this invention is desirable because structural components of hinge element 40, such as hinge leaf 45 and male connector 60 are not visible. The resultant partition apparatus 20 is thus aesthetically pleasing because no external brackets and other hardware is visible. Partition apparatus 20 according to this invention can be easily assembled to produce a clean design.

Figure 13:
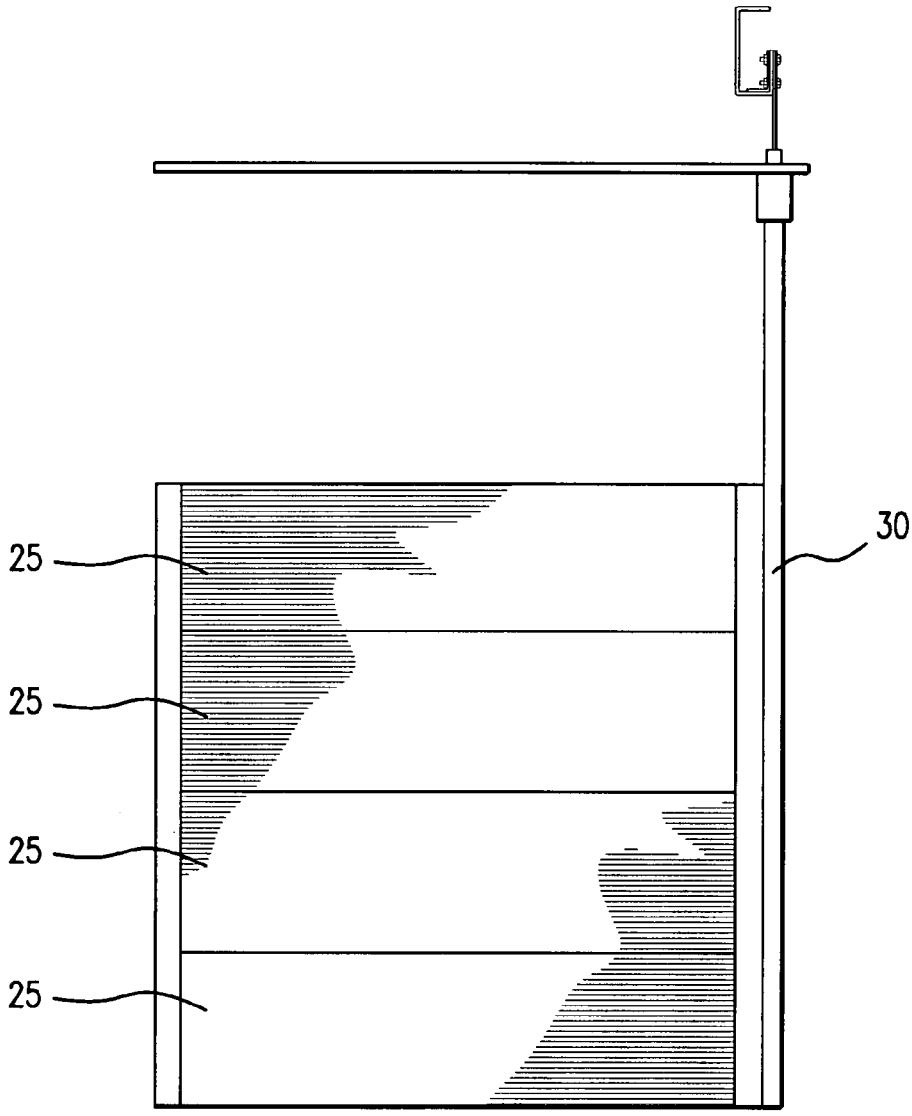
FIG. 13 is a front schematic view of a partition system, showing a wall assembled with a plurality of stacked wall elements, according to one embodiment of this invention.

In another embodiment of this invention, one or more hinge elements 40 can be used in combination with a plurality of panels 30, such as stacked wall elements 25, as shown in FIG. 13. Multiple wall elements 25 can be connected directly to hinge element 40 or can be connected to a pilaster or other structural member that is connected with hinge element 40.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A partition system comprising:

a panel having an edge portion, said panel at least partially defining a slot directed from said edge portion;

a hinge element having hinge leaf mounted to pivot about a hinge axis of said hinge element, said hinge leaf having a peripheral edge with at least one opening extending inward from said peripheral edge toward said hinge axis, said hinge leaf mounted within said slot, and said at least one opening forming a T shape; and a second panel having a second edge portion, said second panel at least partially defining a second slot directed inward from said second edge portion, said hinge element having a second hinge leaf mounted to pivot about said hinge axis, said second hinge leaf having a second peripheral edge with at least one second opening extending inward from said second peripheral edge toward said hinge axis, and said second hinge leaf mounted within said second slot, a first side portion of said first hinge leaf and a second side portion of said second hinge leaf are adjacent each other and formed about a hinge pin that defines said hinge axis, and said first side portion forms a cam surface and said second side portion forms a follower surface that rides on said cam surface to position said panel at an acute angle with respect to said second panel when the partition apparatus is in an open condition.

2. The partition system according to claim 1, further comprising a male connector mounted within said slot, and said male connector removably engageable within said at least one opening for releasably fixing a position of said hinge leaf with respect to said panel.

3. The partition system according to claim 2, wherein said male connector comprises a pin mounted in a fixed position within said first slot.

4. The partition system according to claim 1, wherein said at least one opening diverges in a direction from said peripheral edge toward said hinge axis.

5. The partition system according to claim 1, wherein a base portion of said T shape is positioned adjacent said peripheral edge.

6. The partition system according to claim 2, further comprising a second male connector mounted within said second slot, and said second male connector removably engageable within said at least one second opening for releasably fixing a second position of said second hinge leaf with respect to said second panel.

7. The partition system according to claim 6, wherein said second male connector comprises a second pin mounted in a second fixed position within said second slot.

8. The partition system according to claim 1, wherein said at least one second opening diverges in a direction from said second peripheral edge toward said binge axis.

9. The partition system according to claim 1, wherein said at least one second opening forms a second T shape.

10. The partition system according to claim 9, wherein a base portion of said second T shape is positioned adjacent said second peripheral edge.

11. The partition system according to claim 1, wherein said cain surface is formed as a V shaped cutout of said first side portion.

12. The partition system according to claim 1, wherein said cam surface is formed as a U shaped cutout of said first side portion.

13. The partition system according to claim 1, wherein only said panel defines said slot.

14. The partition system according to claim 1, wherein a male connector is mounted within said first slot, a first end portion of said male connector is secured to said first panel, a second end portion of said male connector is secured to said a supplemental panel, and said male connector is removably engageable within said opening for releasably fixing a position of said hinge leaf with respect to said first panel.

15. The partition system according to claim 1, wherein a side portion of said at least one hinge leaf is formed along more than 180 degrees of an outer circumference of a hinge pin.

16. The partition system according to claim 1, wherein said panel comprises a plurality of individual elements stacked with respect to each other.

17. The partition system according to claim 1, further comprising a plurality of wall elements forming a partition panel, and said wall elements secured with respect to said panel.

18. The hinge apparatus according to claim 1, wherein a general longitudinal axis of said at least one opening is approximately perpendicular to a pin longitudinal axis of said hinge pin.

* * * * *